US009491803B2

(12) United States Patent
Kukino

(10) Patent No.: US 9,491,803 B2
(45) Date of Patent: Nov. 8, 2016

(54) CERAMIC STRUCTURE, CERAMIC HEATER, AND GLOW PLUG INCLUDING THE CERAMIC HEATER

(71) Applicant: KYOCERA Corporation, Kyoto-shi, Kyoto (JP)

(72) Inventor: Hiroshi Kukino, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 181 days.

(21) Appl. No.: 14/361,120

(22) PCT Filed: Nov. 30, 2012

(86) PCT No.: PCT/JP2012/081096
§ 371 (c)(1),
(2) Date: May 28, 2014

(87) PCT Pub. No.: WO2013/081110
PCT Pub. Date: Jun. 6, 2013

(65) Prior Publication Data

US 2014/0299592 A1 Oct. 9, 2014

(30) Foreign Application Priority Data

Nov. 30, 2011 (JP) ..... 2011-262244

(51) Int. Cl.
*F23Q 7/22* (2006.01)
*H05B 3/44* (2006.01)
(Continued)

(52) U.S. Cl.
CPC ..... *H05B 3/10* (2013.01); *F23Q 7/001* (2013.01); *F23Q 7/22* (2013.01); *H05B 3/03* (2013.01);
(Continued)

(58) Field of Classification Search
CPC ..... H05B 3/03; H05B 3/06; H05B 3/10; H05B 3/12; H05B 3/48; H05B 3/141; H05B 3/265; F23Q 7/001; F23Q 7/22
USPC ..... 219/541, 544, 548, 260, 262, 267, 270
See application file for complete search history.

(56) References Cited

U.S. PATENT DOCUMENTS 4,816,643 A * 3/1989 Zulauf ..... F23Q 7/001 123/145 A

FOREIGN PATENT DOCUMENTS

JP 60-211790 A 10/1985
JP 11-144844 A 5/1999
(Continued)

OTHER PUBLICATIONS

Japanese Office Action with concise English explanation, Japanese Patent Application No. 2013-547236, Jun. 2, 2015, 7 pgs.
(Continued)

*Primary Examiner* — Dana Ross
*Assistant Examiner* — Lindsey C Teaters
(74) *Attorney, Agent, or Firm* — Volpe and Koenig, P.C.

(57) ABSTRACT

The ceramic structure of the present invention includes a ceramic substrate, a conductor layer containing a glass component and disposed on a surface of the ceramic substrate, and a brazing filler material covering the surfaces, including the side surfaces, of the conductor layer. A reaction zone of the ceramic substrate, the conductor layer, and the brazing filler material located in a boundary region between the ceramic substrate, the conductor layer, and the brazing filler material.

7 Claims, 1 Drawing Sheet

(51) Int. Cl.

| | |
|---|---|
| ***H05B 3/50*** | (2006.01) |
| ***H05B 3/10*** | (2006.01) |
| ***H05B 3/48*** | (2006.01) |
| ***H05B 3/14*** | (2006.01) |
| ***F23Q 7/00*** | (2006.01) |
| ***H05B 3/03*** | (2006.01) |
| ***H05B 3/12*** | (2006.01) |
| ***H05B 3/26*** | (2006.01) |
| ***H05B 3/06*** | (2006.01) |

(52) U.S. Cl.
CPC *H05B 3/06* (2013.01); *H05B 3/12* (2013.01); *H05B 3/141* (2013.01); *H05B 3/265* (2013.01); *H05B 3/48* (2013.01); *H05B 2203/013* (2013.01); *H05B 2203/027* (2013.01); *H05B 2214/03* (2013.01)

(56) References Cited

FOREIGN PATENT DOCUMENTS

| | | | |
|---|---|---|---|
| JP | 2005-315447 | A | 11/2005 |
| JP | 2006-173222 | A | 6/2006 |
| JP | 2007-294601 | A | 11/2007 |
| JP | 2008-027754 | A | 2/2008 |

OTHER PUBLICATIONS

International Search Report, PCT/JP2012/081096, Dec. 14, 2012, 2 pgs.

* cited by examiner

CERAMIC STRUCTURE, CERAMIC HEATER, AND GLOW PLUG INCLUDING THE CERAMIC HEATER

TECHNICAL FIELD

The present invention relates to a ceramic structure, a ceramic heater, and a glow plug including the ceramic heater that are used in, for example, ignition systems of vehicle-mounted combustion type heaters, heaters for flame detection, heaters for ignition of various combustion devices such as kerosene fan heaters, heaters for glow plugs of automobile engines, heaters for various sensors such as oxygen sensors, or heaters for heating of measuring equipment.

BACKGROUND ART

A glow plug includes a ceramic structure that includes a ceramic substrate, a conductor layer disposed on a surface of the ceramic substrate, and a brazing filler material covering the surface of the conductor layer. The glow plug further includes a metal holding member that is electrically connected to the conductor layer through the brazing filler material and holds the ceramic structure. The glow plug including such a ceramic structure is used for assisting ignition of, for example, a diesel engine. The glow plug is required to have high heat resistance and high durability in order to correspond to increasingly strict environmental regulation (for example, see PTL 1).

However, in ceramic structures constituting conventional glow plugs, operation for a long time could cause a gap in a boundary between the ceramic substrate and the conductor layer. Consequently, when a glow plug including such a ceramic structure is attached to a desired position such as a cylinder, leakage could occur to decrease the air tightness.

The present invention was made in view of the circumstances described above, and it is an object of the invention to provide a ceramic structure, a ceramic heater, and a glow plug including the ceramic heater that are prevented from causing a gap in a boundary between a ceramic substrate and a conductor layer.

CITATION LIST

Patent Literature

PTL 1: Japanese Examined Patent Application Publication No. 5-838

SUMMARY OF INVENTION

The ceramic structure of the present invention includes a ceramic substrate, a conductor layer containing a glass component and disposed on a surface of the ceramic substrate, and a brazing filler material covering the surfaces, including the side surfaces, of the conductor layer. The ceramic structure further includes a reaction zone of the ceramic substrate, the conductor layer, and the brazing filler material in a boundary region between the ceramic substrate, the conductor layer, and the brazing filler material.

In the ceramic heater of the present invention, a resistive element is buried in the ceramic substrate of the ceramic structure.

The glow plug of the present invention includes the ceramic heater and a metal member that is electrically connected to the conductor layer through the brazing filler material and holds the ceramic heater.

DESCRIPTION OF EMBODIMENTS

An example of an embodiment of the ceramic structure of the present invention will be described in detail with reference to the drawings.

Figure 1:
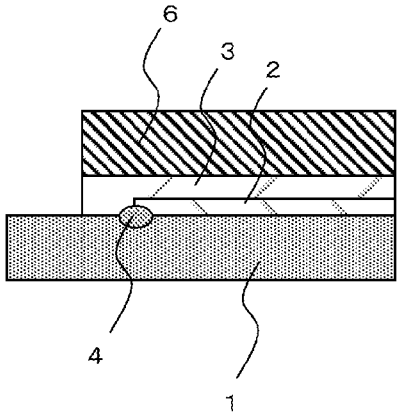
FIG. 1 is a cross-sectional view illustrating an example of the main part of an embodiment of a ceramic structure of the present invention.
Figure 2:
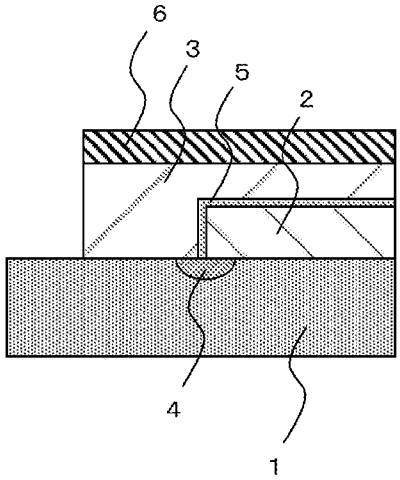
FIG. 2 is a cross-sectional view illustrating another example of the main part of an embodiment of a ceramic structure of the present invention.

FIG. 1 is a cross-sectional view illustrating an example of an embodiment of the ceramic structure of the present invention. The ceramic structure shown in FIG. 1 includes a ceramic substrate 1, a conductor layer 2 disposed on a surface of the ceramic substratel, and a brazing filler material 3 covering the surfaces, including the side surfaces, of the conductor layer 2. The ceramic structure further includes a reaction zone 4 of the ceramic substrate 1, the conductor layer 2, and the brazing filler material 3 in a boundary region between the ceramic substrate 1, the conductor layer 2, and the brazing filler material 3.

The ceramic substrate 1 of the ceramic structure in the embodiment preferably has, for example, a rod-like or plate-like shape. Examples of the ceramics forming the ceramic substratel include ceramics having electrical insulating properties, such as oxide ceramics, nitride ceramics, and carbide ceramics. In particular, the ceramic substrate 1 is preferably made of a silicon nitride ceramics. The silicon nitride ceramics is good in strength, toughness, insulation property, and heat resistance. The silicon nitride ceramics can be prepared by, for example, mixing a rare earth element oxide, such as $Y_2O_3$, $Yb_2O_3$, or $Er_2O_3$, as a sintering aid and $Al_2O_3$ in amounts of 5% to 15% by mass and 0.5% to 5% by mass, respectively, based on the amount of silicon nitride as a main component and $SiO_2$ such that the content of $SiO_2$ after sintering is 1.5 to 5% by mass; and then molding the resulting mixture into a predetermined shape and firing it by, for example, hot-pressing at 1650° C. to 1780° C.

The conductor layer 2 is a patterned conductor containing a glass component. For example, the conductor layer 2 is made of Ni-glass. Examples of the Ni-glass include Ni-glass composed of Ni and borosilicate glass at a mass ratio of 2:1 to 4:1. The conductor layer 2 has a thickness of, for example, 5 to 50 μm. The conductor layer 2 may contain a metal component such as Mn or Ti. In a ceramic structure constituting a glow plug, a resistive element and a lead are buried in the ceramic substrate 1, and the conductor layer 2 is electrically connected to them. The conductor layer 2 is formed by, for example, adding a resin binder to a powder mixture containing a metal powder and a glass powder to produce a metallized paste, applying the paste to the ceramic substrate 1, and firing it at, for example, 850° C. to 1100° C. The metal powder is preferably a metal having a high melting point. In particular, Ni advantageously has both a metallizing property and conductivity. The use of Ni as the metal powder is also preferred from the viewpoint of allowing a good flow of the brazing filler material 3.

The brazing filler material 3 is made of, for example, a Ag—Cu brazing filler metal, a Ag brazing filler metal, or a Cu brazing filler metal. The brazing filler material 3 has a thickness of, for example, 50 to 150 μm. The brazing filler material 3 covers the principal surface of the conductor layer 2. The brazing filler material 3 further covers the side surfaces of the conductor layer 2. That is, brazing filler material 3 covers the surfaces, including the side surfaces, of the conductor layer 2. Here, that the brazing filler material 3 covers the surfaces, including the side surfaces, of the conductor layer 2 means that, in a planar view, the brazing filler material 3 extends to the outside of the conductor layer 2 and is in contact with the ceramic substrate 1. The brazing filler material 3 extends to the outside of the conductor layer 2 by 100 μm or more and preferably by 500 μm from the end face.

A reaction zone 4 of the ceramic substrate 1, the conductor layer 2, and the brazing filler material 3 is located in a boundary region between the ceramic substrate 1, the conductor layer 2, and the brazing filler material 3. The boundary region means the region around a boundary at which the ceramic substrate 1, the conductor layer 2, and the brazing filler material 3 are in contact with one another. The reaction zone 4 in the boundary region is formed during the brazing by the reaction of the ceramic substrate 1, the glass component of the conductor layer 2, and the brazing filler material 3. The formation of the reaction zone 4 can prevent formation of a gap in a boundary between the ceramic substrate 1 and the conductor layer 2.

The reaction zone 4 preferably contains a rare earth element component contained in the ceramic substrate 1, a metal component contained in the brazing filler material 3, and the glass component contained in the conductor layer 2. Such a composition can prevent generation of grain boundaries in the reaction zone 4. Consequently, gas is prevented from passing through the reaction zone 4. As a result, in application of such a ceramic structure to a glow plug described below, the air tightness can be further maintained. Examples of rare earth element contained in the reaction zone 4 include Y, Yb, and Er. Examples of the metal component contained in the reaction zone 4 include Cu and Ag.

The reaction zone 4 preferably contains an oxide. When the ceramic substrate 1, the conductor layer 2, and the brazing filler material 3 react with one another, the glass component of the conductor layer 2 supplies oxygen. The oxygen allows the reaction zone 4 to contain an oxide. The reaction zone 4 can improve the environmental resistance thereof by containing the oxide. Consequently, the formation of a gap in a boundary between the ceramic substrate 1 and the conductor layer 2 can be further prevented.

A part of the reaction zone 4 preferably penetrates into the ceramic substrate 1. Specifically, for example, penetration to a depth of about 1 to 5 μm with a width of about 1 to 20 μm is effective. This structure can inhibit external gas from passing through the inside of the ceramic substrate 1 and from entering between the ceramic substrate 1 and the conductor layer 2. As a result, in application of such a ceramic structure to a glow plug described below, the air tightness can be further maintained. Furthermore, the penetration of the reaction zone 4 into the ceramic substrate 1 causes an anchor effect between the reaction zone 4 and the ceramic substrate 1. As a result, in application of such a ceramic structure to a glow plug described below, the strength can be further enhanced.

Alternatively, a part of the reaction zone 4 preferably penetrates into the grain boundaries of the ceramics forming the ceramic substrate 1. Penetration of the reaction zone 4 into the grain boundaries of ceramics further increases the adhesive strength between the reaction zone 4 and the ceramic substrate 1. As a result, the environmental resistance of the ceramic structure can be further improved.

A plating film 5 may be disposed on the surface of the conductor layer 2. Examples of the plating film 5 include Ni plating and Zn plating films. The plating film 5 can have a thickness of, for example, 0.2 to 5 μm. In this structure, since the plating film 5 covers the conductor layer 2, the air tightness is further maintained when such a ceramic structure is applied to a glow plug described below.

The ceramic structure preferably further includes a metal member 6 electrically connected to the conductor layer 2 through the brazing filler material 3. The metal member 6 is a cylindrical member holding the ceramic structure. The metal member 6 is made of, for example, stainless steel or a Fe—Ni—Co alloy.

Figure 3:
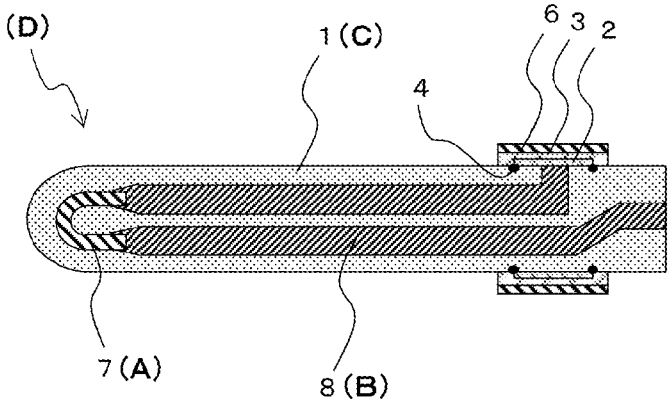
FIG. 3 is a cross-sectional view illustrating an example of an embodiment of a ceramic heater of the present invention and a glow plug including it.

As shown in FIG. 3, the ceramic heater includes a resistive element 7 buried in the ceramic substrate 1 of the above-described ceramic structure. In this ceramic heater, the resistive element 7 buried in the ceramic substrate 1 has a folded-back shape, and both ends of the resistive element 7 are connected to respective leads 8. The resistive element 7 and the leads 8 each have a main component of a carbide, nitride, or silicide of a metal such as W, Mo, or Ti. The resistive element and the leads 8 may each contain a material forming the ceramic substrate 1 for adjusting the coefficient of thermal expansion. The resistive element 7 has a high resistance value and is thereby apt to generate heat. In particular, the heat is mostly generated near the middle point of the folded-back portion of the resistive element 7. Meanwhile, the leads 8 contain the material forming the ceramic substrate 1 in an amount smaller than that in the resistive element 7. The leads 8 each have a cross-sectional area larger than that of the resistive element 7. In such a structure, the leads 8 each have a lower resistance value per unit length than that of the resistive element 7.

In such a ceramic heater, the formation of a gap in a boundary between the ceramic substrate 1 and the conductor layer 2 of the ceramic structure can be prevented as described above, which allows stable use for a long period of time.

As shown in FIG. 3, the glow plug includes the above-described ceramic heater and a metal member 6 electrically connected to the conductor layer 2 through the brazing filler material 3 and holding the ceramic heater. The metal member 6 is a cylindrical member holding the ceramic structure. The metal member 6 is made of, for example, stainless steel or a Fe—Ni—Co alloy and is connected to the conductor layer 2 with the brazing filler material 3. The ceramic heater in which the formation of a gap in the boundary between the ceramic substrate 1 and the conductor layer 2 is thus prevented allows the glow plug to be stably used for a long period of time. A structure in which the metal member 6 protrudes longer than the conductor layer 2 such that the ceramic substrate 1 and the metal member 6 face each other without having the conductor layer 2 there between is preferred. Consequently, in the ceramic structure constituting the glow plug, the brazing filler material 3 can easily cover the side surfaces of the conductor layer 2. As a result, the reaction zone 4 can be readily formed.

A method of producing the glow plug of the embodiment will now be described.

First, a conductive paste, for the resistive element 7 and the leads 8, containing a conductive ceramic powder, a resin binder, and other components is prepared. A ceramic paste, for the ceramic substrate 1, containing an insulative powder, a resin binder, and other components is prepared.

Then, the conductive paste is molded by, for example, injection molding into a compact (compact A) having a predetermined pattern that becomes the resistive element 7. The die holding the compact A is filled with the conductive paste to mold a compact (compact B) having a predetermined pattern that becomes the leads 8. Consequently, the compact A and the compact B connected to the compact A are in a state being held in the die.

Then, the die holding the compact A and the compact B is partially replaced with a die for forming the ceramic substrate 1, and the ceramic paste is packed in the die and is molded into the ceramic substrate 1. Consequently, a compact (compact D) for the ceramic heater in which the compact A and the compact B are covered with a compact (compact C) of the ceramic paste is prepared.

The resulting compact D is fired, for example, at a temperature of 1650° C. to 1780° C. and a pressure of 30 to 50 MPa to produce a ceramic heater. The firing is preferably performed in a non-oxidizing gas atmosphere such as a hydrogen gas.

A metallized paste prepared by adding a resin binder to a powder mixture containing a metal powder and a glass powder is applied to the ceramic substrate 1 prepared by firing, followed by firing at, for example, 850° C. to 1100° C. to form a conductor layer 2 on the surface of the ceramic substrate 1.

Then, a brazing filler material 3 is placed so as to cover the surfaces, including the side surfaces, of the conductor layer 2 to braze the metal member 6. For example, a Ag—Cu brazing filler metal is brazed at 800° C. to 1000° C. Specifically, a metal member 6 is placed at a desired position, and a floating brazing filler material is packed between the ceramic substrate 1 and the metal member 6, followed by brazing. Here, in order to form a reaction zone 4 of the ceramic substrate 1, the conductor layer 2, and the brazing filler material 3, not only merely performing heating, it is important to have a time for accelerating the reaction. Specifically, heating at 700° C. or more is preferably performed for about 10 to 30 minutes. Consequently, a reaction zone 4 can be successfully formed. On this occasion, the temperature is preferably increased to 700° C. at a temperature rising rate of 5° C./min or less. The brazing is preferably performed in an Ar atmosphere. Heating under these conditions allows the glass component of the conductor layer 2 to be readily molten. As a result, the formation of the reaction zone 4 is accelerated.

The glow plug of the present invention can be prepared by the method described above.

EXAMPLES

A glow plug of an example of the present invention was prepared as follows.

First, a conductive paste containing 50% by mass of a tungsten carbide (WC) powder, 35% by mass of a silicon nitride ($Si_3N_4$) powder, and 15% by mass of a resin binder was injection-molded into a die to produce a compact A becoming a resistive element.

Then, the die holding the compact A was filled with the conductive paste becoming leads, and thereby a compact B becoming leads by being connected to the compact A was formed.

Then, a ceramic paste containing 85% by mass of a silicon nitride ($Si_3N_4$) powder, 10% by mass of an oxide of ytterbium (Yb) ($Yb_2O$) as a sintering aid, and 5% by mass of WC for approximating the coefficient of thermal expansion to that of the resistive element and leads was injection-molded into the die holding the compact A and the compact B. Consequently, as shown in FIG. 3, a compact D having a structure in which the compact A and the compact B were buried in a compact C becoming a ceramic substrate was formed.

Then, the resulting compact D was put in a cylindrical carbon mold and was hot-pressed at a temperature of 1700° C. and a pressure of 35 MPa in a non-oxidizing gas atmosphere composed of a nitrogen gas. A conductor layer made of Ni-glass was applied to a lead end exposed to the surface of the resulting sintered compact and was fired at 1000° C. Subsequently, a Ni plating having a thickness of 0.5 to 1 μm was formed on the surface of the conductor layer by electroless barrel plating. An SUS430 metal member was brazed on the conductor layer provided with the plating to produce a glow plug of the example of the present invention.

Here, the brazing filler material was formed using a Ag—Cu brazing filler metal so as to extend to the outside of the conductor layer by 50 μm. The brazing was performed in an Ar atmosphere by heating at 700° C. or more for 30 minutes.

The glow plug after brazing was investigated, and it was confirmed that the reaction zone 4 had a thickness of 10 μm and penetrated into the ceramic substrate 1 by about 3 μm. The presence of the reaction zone 4 was confirmed by the following method. Specifically, the position of the reaction zone 4 was confirmed with an X-ray microanalyzer, and the presence of Ag, Cu, Si, O, and Yb was confirmed by X-ray photoelectron spectroscopy. Observation of a cross-section with a microscope confirmed that a part of the reaction zone 4 partially broke the plating film 5 and was present between the conductor layer 2 and the brazing filler material 3. In other words, a through-hole was formed in the plating film 5, and the reaction zone 4 was formed inside the through-hole. In this case, it is believed that an anchor effect acted between the plating film 5 and the reaction zone 4 and that as a result, the bonding strength between the plating film 5 and the reaction zone 4 has been improved.

A cooling cycle test was performed with this heater, and then an air tightness test was performed. In the cooling cycle test, the heater was put in a furnace, and the temperature was raised to 400° C. in 2 minutes. Subsequently, the heater was taken out from the furnace and was cooled to 100° C. by ventilation with a fan. This procedure was defined as one cycle and was repeated for 1000 times. The air tightness was tested in accordance with JIS 2233 Helium leak test (vacuum spray method) with a He leak tester. The change in air tightness of the glow plug between before and after the cooling cycle test was measured to confirm that no leak occurred in the glow plug of Example.

REFERENCE SIGNS LIST ceramic substrate
conductor layer
brazing filler material
reaction zone
plating film
metal holding member
resistive element
lead

The invention claimed is:

1. A ceramic structure comprising a ceramic substrate, a conductor layer containing a glass component and disposed on a surface of the ceramic substrate, and a brazing filler material covering a surface of the conductor layer and side surfaces of the conductor layer, wherein a reaction zone of the ceramic substrate, the conductor layer, and the brazing filler material is located in a boundary region between the ceramic substrate, the conductor layer, and the brazing filler material, wherein the ceramic substrate contains a rare earth element component as a sintering aid; and the reaction zone contains a metal component contained in the brazing filler material, the glass component contained in the conductor layer, and the rare earth element component contained in the ceramic substrate.

2. The ceramic structure according to claim 1, wherein the rare earth element component contains Y, Yb, or Er, and the metal component contains Ag or Cu.

3. The ceramic structure according to claim 2, wherein the reaction zone contains an oxide.

4. A ceramic heater comprising a resistive element buried in the ceramic substrate of a ceramic structure according to claim 1.

5. A glow plug comprising a ceramic heater according to claim 4 and a metal member holding the ceramic heater by being electrically connected to the conductor layer through the brazing filler material.

6. A ceramic structure comprising a ceramic substrate, a conductor layer containing a glass component and disposed on a surface of the ceramic substrate, and a brazing filler material covering a surface of the conductor layer and side surfaces of the conductor layer, wherein a reaction zone of the ceramic substrate, the conductor layer, and the brazing filler material is located in a boundary region between the ceramic substrate, the conductor layer, and the brazing filler material, wherein a plating film is disposed on the surface of the conductor layer.

7. A ceramic structure comprising a ceramic substrate, a conductor layer containing a glass component and disposed on a surface of the ceramic substrate, and a brazing filler material covering a surface of the conductor layer and side surfaces of the conductor layer, wherein a reaction zone of the ceramic substrate, the conductor layer, and the brazing filler material is located in a boundary region between the ceramic substrate, the conductor layer, and the brazing filler material, further comprising a metal member electrically connected to the conductor layer through the brazing filler material.

* * * * *